US007937802B2

(12) United States Patent
Yoo et al.

(10) Patent No.: US 7,937,802 B2
(45) Date of Patent: May 10, 2011

(54) VACUUM CLEANER FOR USE IN BOTH UPRIGHT FORM AND CANISTER FORM

(75) Inventors: Dong-hun Yoo, Gwangju (KR); Jeong-hee Cho, Gwangju (KR); Myoung-sun Choung, Gwangju (KR); Yun-hee Park, Gwangju (KR); Il-du Jung, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 660 days.

(21) Appl. No.: 12/012,339

(22) Filed: Feb. 1, 2008

(65) Prior Publication Data

US 2009/0044371 A1 Feb. 19, 2009

Related U.S. Application Data

(60) Provisional application No. 60/964,676, filed on Aug. 14, 2007.

(30) Foreign Application Priority Data

Sep. 14, 2007 (KR) ..... 10-2007-0093880

(51) Int. Cl.
*A47L 5/30* (2006.01)

(52) U.S. Cl. ..... 15/329; 15/331; 15/334; 15/345

(58) Field of Classification Search ..... 15/329, 15/331, 334, 335; *A47L 5/30*
See application file for complete search history.

(56) References Cited

U.S. PATENT DOCUMENTS

| | | | | |
|---|---|---|---|---|
| 5,715,566 | A | 2/1998 | Weaver et al. | 15/320 |
| 7,600,291 | B2 * | 10/2009 | Choi | 15/329 |

FOREIGN PATENT DOCUMENTS

| | | |
|---|---|---|
| GB | 2398486 | 8/2004 |
| KR | 1020050001766 | 1/2005 |

OTHER PUBLICATIONS

Search and Examination Report dated Sep. 9, 2008 corresponding to United Kingdom Patent Application No. 0809680.2.

* cited by examiner

*Primary Examiner* — David A Redding
(74) *Attorney, Agent, or Firm* — Ohlandt, Greeley, Ruggiero & Perle, LLP

(57) ABSTRACT

A vacuum cleaner for use in both an upright form and a canister form, which can mount and dismount a cleaner body to and from a suction nozzle assembly is disclosed. The vacuum cleaner includes a suction nozzle assembly to draw in dust or dirt along with air while moving along a surface to be cleaned; a cleaner body having a dust separating unit to separate and collect the dust or dirt from the air drawn in from the surface to be cleaned; a supporting unit hingedly joined to the suction nozzle assembly to support a lower part of the cleaner body to communicate with the suction nozzle assembly; and a locking unit to detachably lock the lower part of the cleaner body to the supporting unit.

8 Claims, 8 Drawing Sheets

VACUUM CLEANER FOR USE IN BOTH UPRIGHT FORM AND CANISTER FORM

CROSS-REFERENCE TO RELATED APPLICATIONS

This application claims the benefit under 35 U.S.C. §119 (e) of U.S. Provisional Patent Application No. 60/964,676, filed Aug. 14, 2007, in the United States Patent and Trademark Office, and claims the benefit under 35 U.S.C. §119(a) of Korean Patent Application No. 10-2007-0093880, filed on Sep. 14, 2007, in the Korean Intellectual Property Office, the entire contents of both of which are hereby incorporated by reference.

BACKGROUND OF THE INVENTION

1. Field of the Invention

The present disclosure relates to a vacuum cleaner. More particularly, the present disclosure relates to a vacuum cleaner for use in both an upright form and a canister form, where the vacuum cleaner is configured to separate a cleaner body having a dust separating unit and a suction motor from a supporting unit during use in the canister form.

2. Description of the Related Art

In general, an upright vacuum cleaner forcibly draws in dust or dirt along with air from the outside by a suction force generated within a cleaner body, so that it cleans a surface to be cleaned, such as a floor, a carpet, or the like.

Such an upright vacuum cleaner is provided with a cleaner body, and a suction nozzle assembly installed under the cleaner body to be movable along the surface to be cleaned. In addition, the cleaner body includes a dust separating unit to collect the dust or dirt drawn in from the surface to be cleaned and a motor chamber in which a suction motor is installed. The suction motor is disposed on a lower side of the dust separating unit. The upright vacuum cleaner is usually used in cleaning a relatively wide cleaning area, such as the floor or the carpet.

However, the conventional upright vacuum cleaner is configured, so that the cleaner body and the suction nozzle assembly are hingedly connected with each other so not to separate from each other. Accordingly, if the vacuum cleaner cleans a relatively narrow cleaning area, such as a stairway or a break, beside the relatively wide cleaning area, such as the floor, it is not only difficult to move, but also to carry out an cleaning operation due to its weight. Also, to clean a narrow cleaning area or a portion having a protrusion on a floor, a user must purchase a separate subsidiary brush or accessory therefor, or separately purchase a canister vacuum cleaner, thereby causing her or him to have an economic burden.

To address the problems as described above, the present applicant has proposed an upright vacuum cleaner having a locking part, which can separate both side surfaces of the cleaner body from a supporting member hingedly joined to the suction nozzle assembly, as disclosed in Korean patent No. 474083. In this upright vacuum cleaner, the locking part is provided with a button operating part elastically supported to a handle part of the cleaner body, a joining protrusion integrally formed on the button operating part, and a joining protrusion groove formed on the supporting member. Accordingly, to separate both side surfaces of the cleaner body from the supporting member, the user pushes the button operating part so that the joining protrusion of the button operating part is released from the joining protrusion groove of the supporting member. As a result, the cleaner body can be separated from the supporting member.

However, the conventional separate type upright vacuum cleaner as described above is configured, so that the both side surfaces of the cleaner body is mounted on or separated from the supporting member in the form of an arch larger than an outer circumference of the cleaner body. Thus, the conventional vacuum cleaner is disadvantageous in that it is not only difficult to attach various accessories, such as an extended hose, etc., on the cleaner body, but also increases in size.

SUMMARY OF THE INVENTION

An aspect of the present disclosure is to address at least the above problems and/or disadvantages and to provide at least the advantages described below. Accordingly, an aspect of the present disclosure is to provide a vacuum cleaner for use in both an upright form and a canister form, capable of easily coupling and separating a cleaner body to and from a supporting unit while compactly maintaining a volume of the cleaner.

In accordance with an aspect of the present disclosure, a vacuum cleaner includes a suction nozzle assembly to draw in dust or dirt along with air while moving along a surface to be cleaned; a cleaner body having a dust separating unit to separate and collect the dust or dirt from the air drawn in from the surface to be cleaned; a supporting unit hinged and joined to the suction nozzle assembly to support a lower part of the cleaner body to communicate with the suction nozzle assembly; and a locking unit to detachably lock the lower part of the cleaner body to the supporting unit.

Here, the cleaner body may further include an extended tube assembly detachably disposed in a longitudinal direction on one side of the cleaner body to communicate with the cleaner body. Preferably, but not necessarily, the extended tube assembly includes a suction hose connected to the cleaner body to communicate with the cleaner body, an operating handle connected to the suction hose, and an extended tube having one end to connected to the operating handle. In this case, the other end of the extended tube is connected to the suction nozzle assembly to act as an air flowing passage when the vacuum cleaner is used in a upright form, and is separated from the suction nozzle assembly and joined with a suction brush or different accessory for cleaning a narrow region or a portion having a protrusion on a floor when the vacuum cleaner is used in a canister form.

The locking unit may include a first locking part to support a lower surface of the cleaner body and the supporting unit so as not to move to each other, and a second locking part to detachably fix one side surface of a lower part of the cleaner body and the supporting unit to each other.

Preferably, but not necessarily, the first locking part includes at least one projection formed on the lower surface of the cleaner body, and at least one recess formed opposite to the at least one projection on the supporting unit. In this case, the at least one projection may include first and second projections formed on bottom surfaces of supporting mounts formed in a spaced-apart relation to each other in front of the lower surface of the cleaner body, and a third projection formed in a middle of the lower surface of the cleaner body, and the at least one recess may include first and second recesses formed opposite to the first and the second projections on the supporting unit, and a third recess formed opposite to the third projection on the supporting unit.

Also, preferably, but not necessarily, the second locking part includes at least one locking groove formed on the one side surface of the lower part of the cleaner body, a locking member rotatably supported on the supporting unit, and having at least one hook locked in the at least one locking groove when the cleaner body is mounted on the supporting unit, and an elastic member to elastically urge the locking member to allow the at least one hook to be locked in the at least one locking groove when the cleaner body is mounted on the supporting unit. In this case, preferably, but not necessarily, the locking member includes an Y-shaped lever, a first end of which has at least one hook projecting out of the supporting unit toward the at least one locking groove, a second end of which has a pedal projecting out of the supporting unit to allow a user to push, and a third end of which has a contact part disposed in the supporting unit to come in contact with the lower surface of the cleaner body and thus to lift up the cleaner body when the pedal is pushed. Alternatively, the locking member may include an L-shaped lever, a first end of which has at least one hook projecting out of the supporting unit toward the at least one locking groove, and a second end of which has a pedal projecting out of the supporting unit to allow a user to push.

The second locking part may further includes a positioning member configured to ensure that the at least one hook is locked in the at least one locking groove when the cleaner body is mounted on the supporting unit. Preferably, but not necessarily, the positioning member includes a positioning groove formed in a rear of the lower surface of the cleaner body adjacent to the at least one locking groove, and a positioning projection projecting from the supporting unit to face the positioning groove while being spaced-apart from the at least one hook.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a vacuum cleaner for use in both an upright form and a canister form according to exemplary embodiments of the present disclosure will be described in detail with reference to the accompanying drawing figures.

Figure 1:
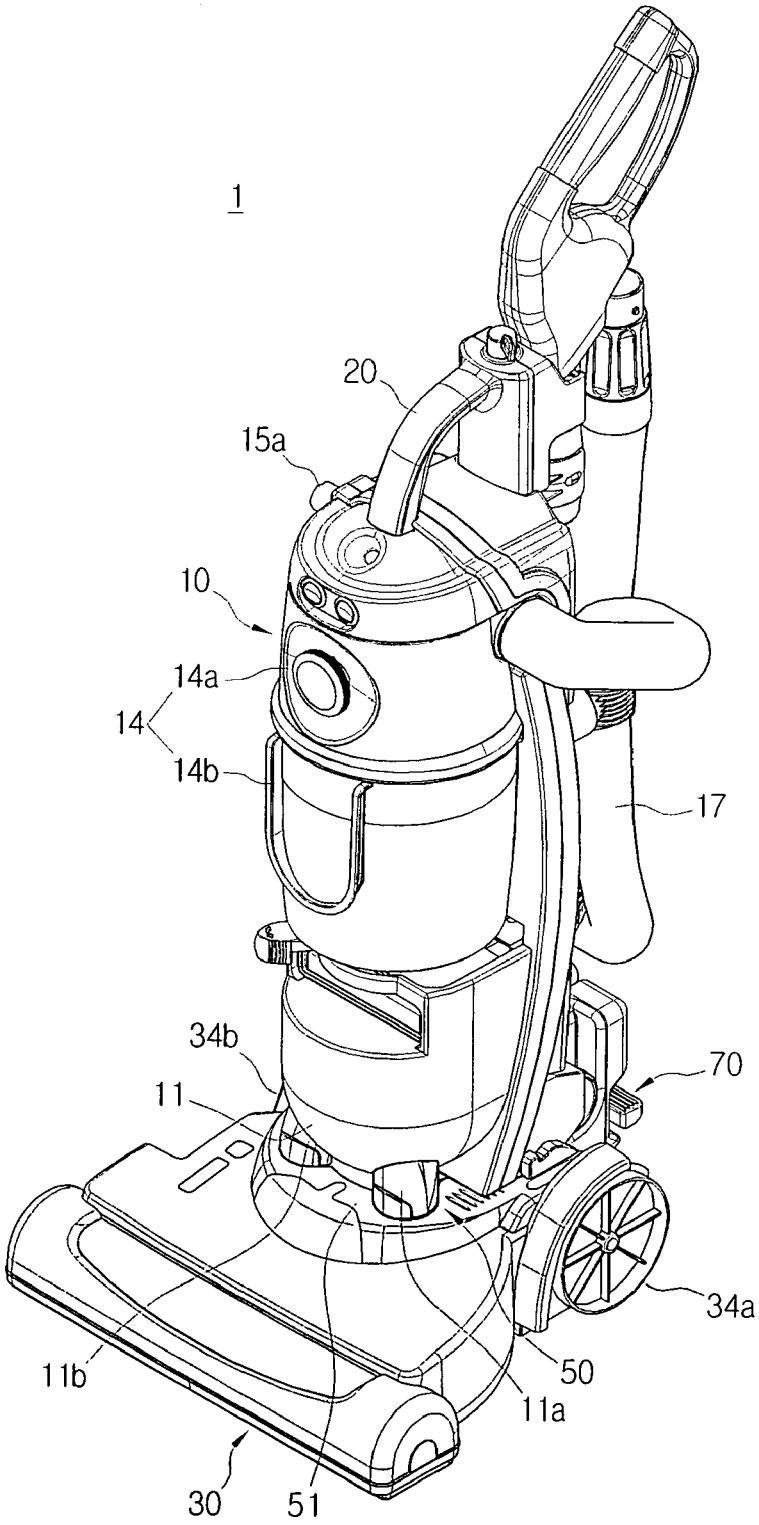
FIG. 1 is a front perspective view exemplifying a vacuum cleaner for use in both an upright form and a canister form according to an exemplary embodiment of the present disclosure when it is used in the upright form.
Figure 2:
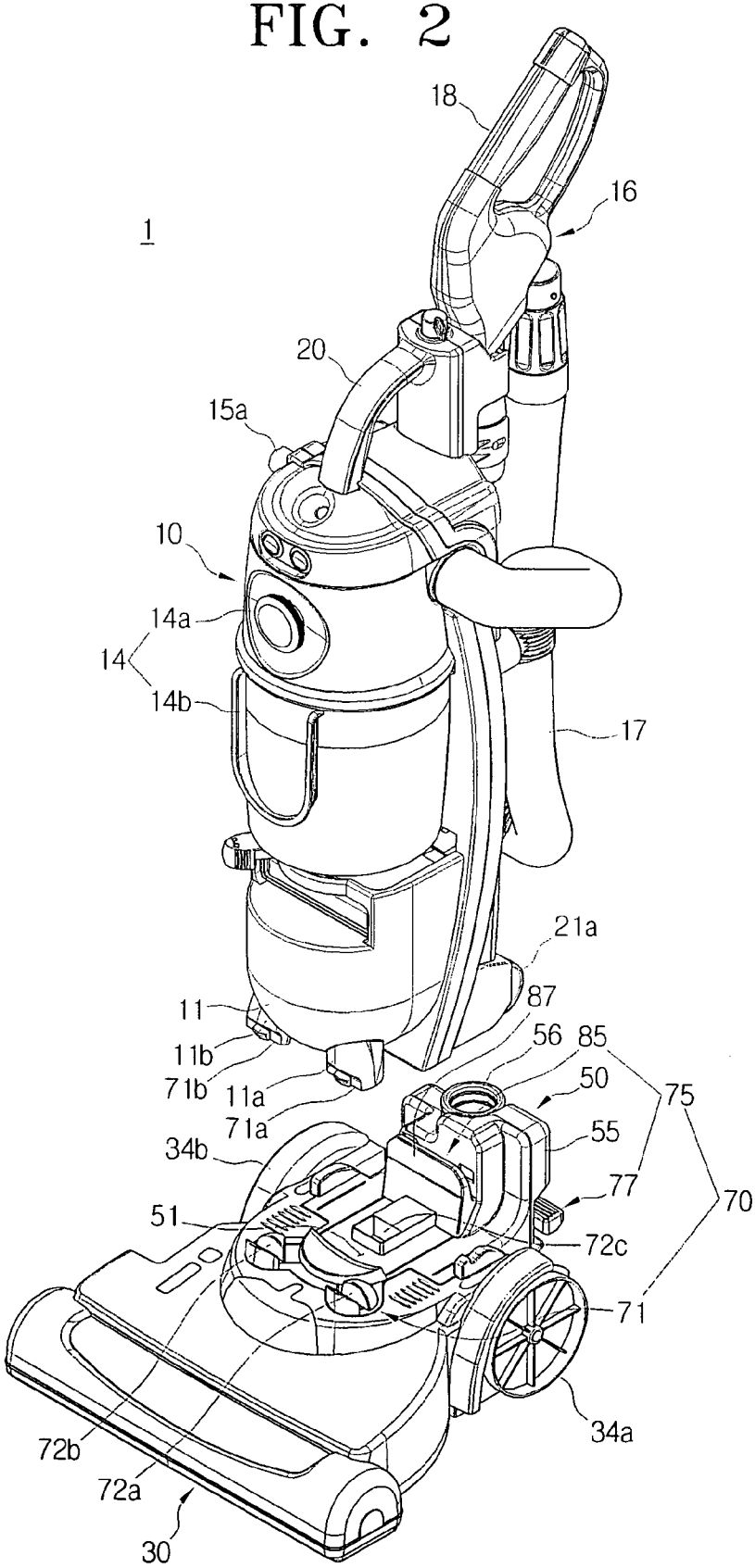
FIG. 2 is a front perspective view exemplifying the vacuum cleaner illustrated in FIG. 1 when it is used in the canister form.

FIG. 1 is a perspective view exemplifying a vacuum cleaner for use in both an upright form and a canister form according to an exemplary embodiment of the present disclosure when it is used in an upright form where a cleaner body is mounted on a supporting unit and vertically positioned, and FIG. 2 is an exploded perspective view exemplifying the vacuum cleaner when it is used in the canister form where the cleaner body is separated from the supporting unit.

Referring to FIGS. 1 and 2, the vacuum cleaner 1 for use in both the upright form and the canister form according to the exemplary embodiment of the present disclosure includes a cleaner body 10, a suction nozzle assembly 30, a supporting unit 50, and a locking unit 70.

Figure 5:
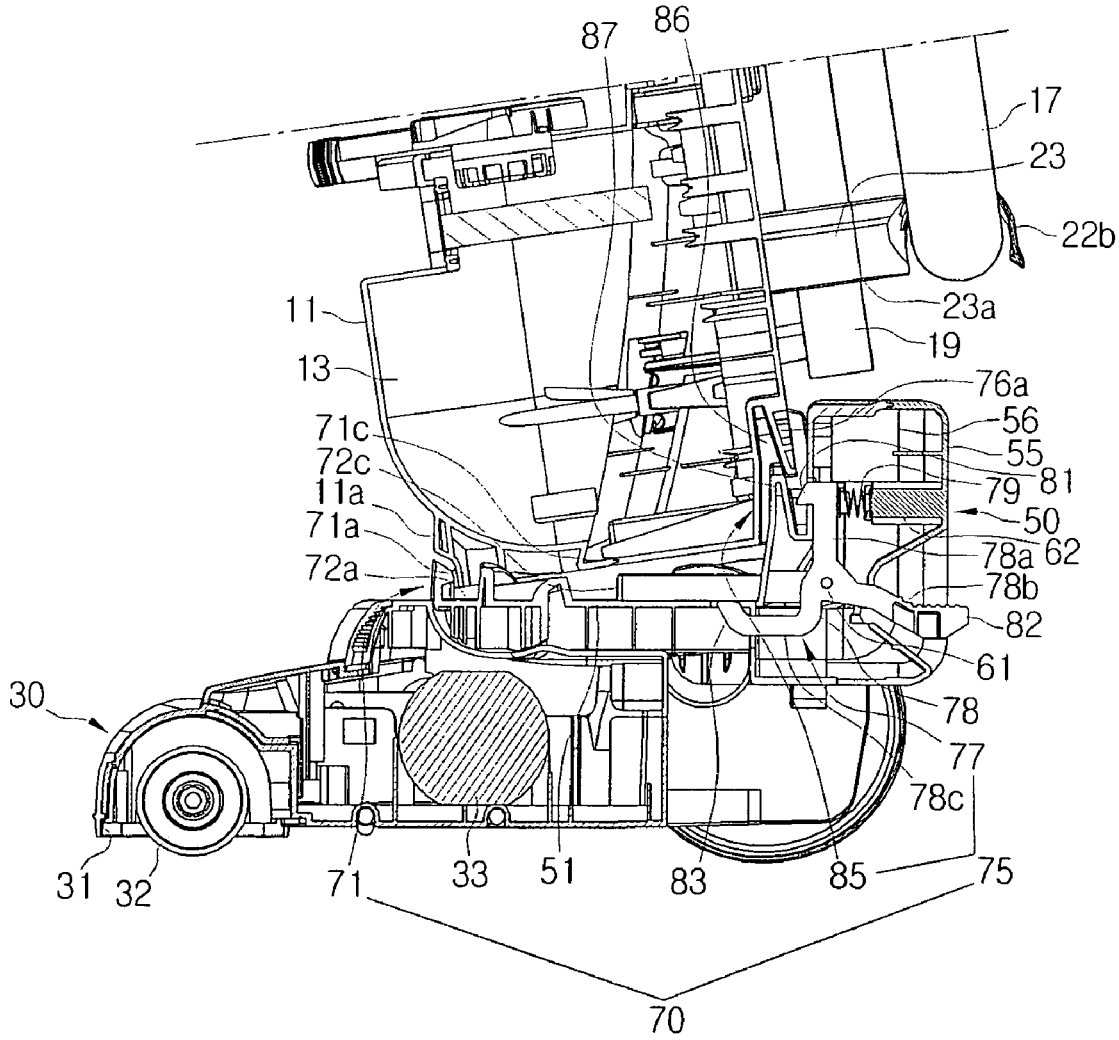
FIGS. 5 through 7 are partial cross-sectional views exemplifying an operation of a locking unit of the vacuum cleaner illustrated in FIG. 1.

As illustrated in FIG. 5, the cleaner body 10 at a lower part 11 thereof has a motor chamber 13 in which a suction motor (not illustrated) is mounted. As illustrated in FIGS. 1 and 2, the cleaner body 10 has at an upper side of the lower part 11 has a dust separating unit 14 for separating dust or dirt, which is separately disposed from the motor chamber 13. The dust separating unit 14 includes a cyclone part 14*a* and a dust bin 14*b*. The cyclone part 14*a* separates dust or dirt drawn in along with air from the outside therefrom and discharges the air from which the dust or dirt is separated. The dust bin 14*b* is disposed on a lower side of the cyclone part 14*a* to collect the dust or dirt separated by the cyclone part 14*a*. The dust bin 14*b* is detachably joined between the cyclone part 14*a* and the lower part 11 of the cleaner body 10, so that a user can empty it of the collected dust or dirt.

Figure 3:
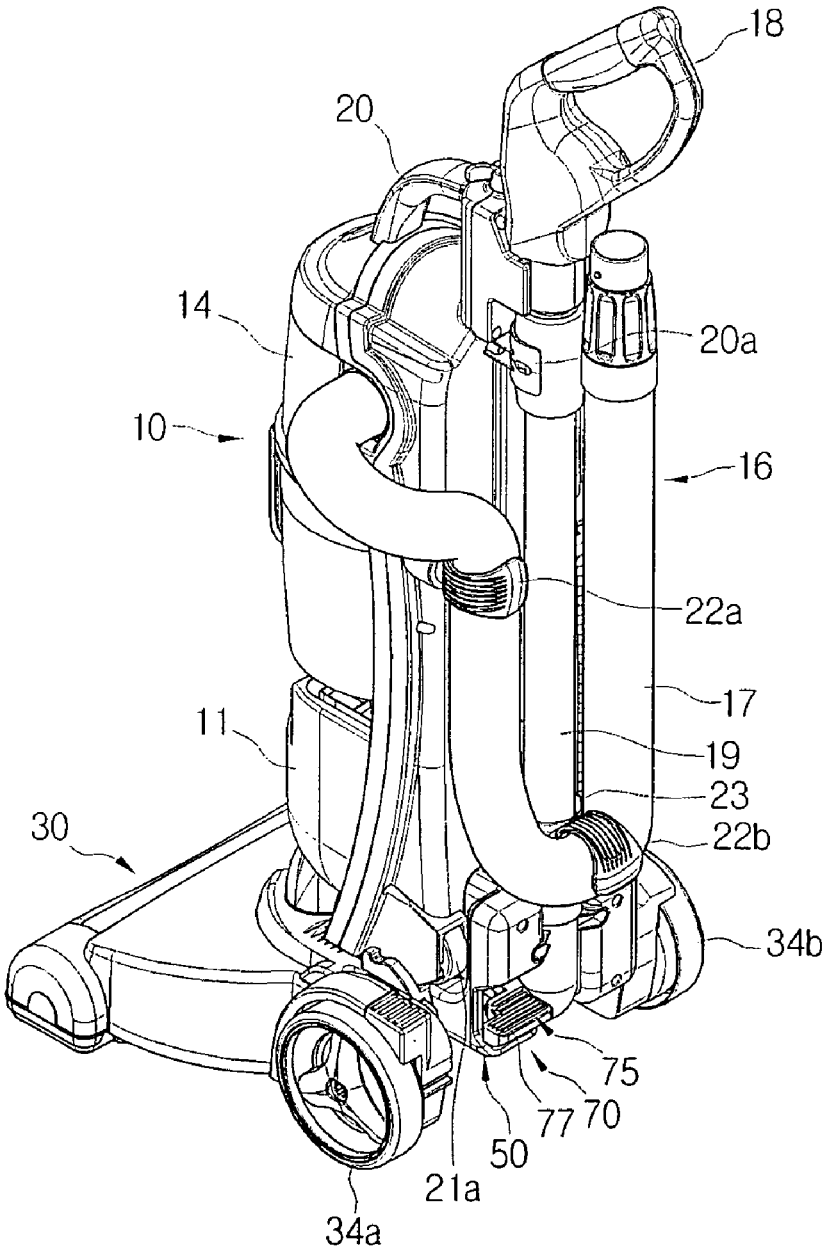
FIG. 3 is a rear perspective view of the vacuum cleaner illustrated in FIG. 1 from which various components have been omitted for purposes of clarity.
Figure 4:
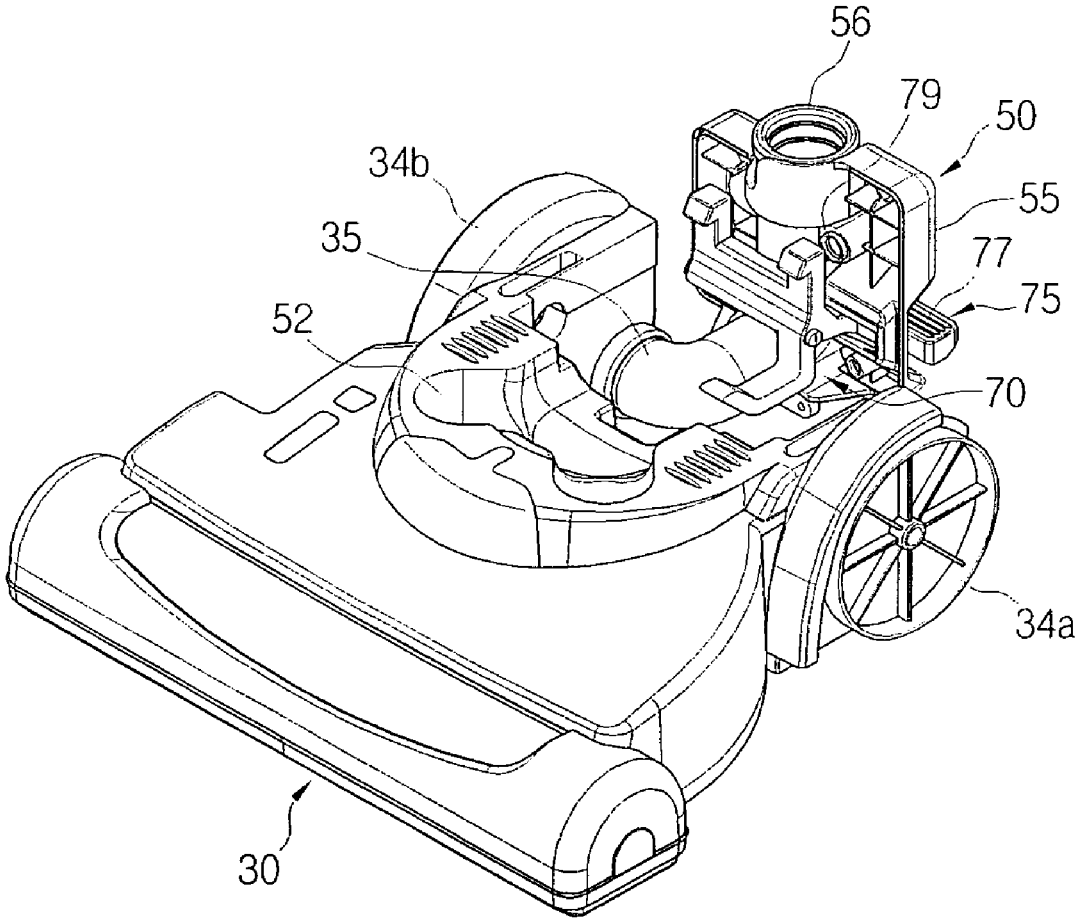
FIG. 4 is a front perspective view exemplifying a suction nozzle assembly of the vacuum cleaner illustrated in FIG. 2 from which various components have been omitted for purposes of clarity.

In addition, the cleaner body 10 at one side surface thereof has a power cord (not illustrated), which is wound by a pair of winding protrusions 15*a* (only one illustrated in FIG. 1) formed in a spaced-apart relation to each other on upper and lower parts of the dust separating unit 14, and at an upper part thereof has a body handle 20. To smoothly move the cleaner body 10 along a surface to be cleaned when the vacuum cleaner 1 is used in a canister form, as illustrated in FIG. 2, that is, when the cleaner body 10 is separated from the supporting unit 50 and separately used from the suction nozzle assembly 30, first and second small wheels 21*a* (only one illustrated in FIGS. 2 and 3) are installed on a lower part of a rear surface of the cleaner body 10.

Also, an extended tube assembly 16 is detachably disposed on the rear surface of the cleaner body 10. As illustrated in detail in FIG. 3, the extended tube assembly 16 is made up of an extended hose 17, an operation handle 18, and an extended tube 19. The extended hose 17 at one end thereof is joined with the cyclone part 14*a* of the dust separating unit 14 of the cleaner body 10 to communicate therewith, and is fixedly supported on the rear surface of the cleaner body 10 by upper and lower hose hangers 22*a* and 22*b*. Here, the upper hose hanger 22*a* is formed on one side of the upper part of the rear surface of the cleaner body 10, and the lower hose hanger 22*b* is formed on an extended tube fixing part 23 formed on the lower part of the rear surface of the cleaner body 10. The operating handle 18 at a rear end thereof is connected to the other end of the extended hose 17, and at a front end thereof is inserted and supported in an opening groove 20*a*, which is formed on a rear side of the body handle 20 installed on the upper part of the cleaner body 10.

The extended tube 19 at an upper end thereof is connected to the front end of the operating handle 18. As illustrated in FIG. 1, when the vacuum cleaner 1 is used in the upright form, that is when the cleaner body 10 is mounted on the supporting unit 50 and used along with the suction nozzle assembly 30, a lower end of the extended tube 19 is inserted into and connected to a connecting tube 56 of a hinge member 55 of the supporting unit 50 to be explained later through a supporting hole 23*a* of the extended tube fixing part 23, as illustrated in FIG. 5, so that it acts as an air flowing passage from the suction nozzle assembly 30 to the cleaner body 10. To the contrary, as illustrated in FIG. 2, when the vacuum cleaner 1 is used in the canister form, that is, when the cleaner body 10 is separated from the supporting unit 50 and separately used from the suction nozzle assembly 30, the lower end of the extended tube 19 is separated from the connecting tube 56 of the hinge member 55, so that it is connected to a suction brush or other accessory (not illustrated), which can clean a narrow region or area or a portion having a protrusion on a floor.

Referring to FIG. 5, the suction nozzle assembly 30 at a bottom surface thereof has an inlet 31 for drawing in air from the surface to be cleaned. In the vicinity of the inlet 31 is installed a drum brush 32, which brushes off dust or dirt adhered to the surface to be cleaned. The drum brush 32 is connected to a driving axis of a driving motor 33 through a power transmitting unit (not illustrated), such as a belt, a gear or the like, and is driven to rotate by the driving motor 33. In addition, in the suction nozzle assembly 30 is formed an air passage (not illustrated) through which the air drawn in through the inlet 31 flows. The suction nozzle assembly 30 includes, on both sides of the rear of the suction nozzle assembly 30, rotatably joined first and second large wheels 34*a* and 34*b* (see FIGS. 1 through 4), which allow the suction nozzle assembly 30 to smoothly move along the surface to be cleaned, respectively.

Referring to FIGS. 2 through 5, the supporting unit 50 mounts and supports the lower part 11 of the cleaner body 10, and at a lower part thereof is hingedly joined to the middle of the rear of the suction nozzle assembly 30. The supporting unit 50 is made up of a supporting member 51 and a hinge member 55, which are joined to each other through joining means (not illustrated), such as screws or the like. The supporting member 51 is formed of an L-shaped plate having an L-shaped supporting surface, which supports the lower surface and the rear surface of the cleaner body 10. The supporting member 51 is seated in a recess 52 (see FIG. 4) formed in a shape corresponding to that of the supporting member 51 on an upper surface of the suction nozzle assembly 30. The hinge member 55 at a lower part thereof is hingedly joined to the suction nozzle assembly 30, and at one side thereof has the connecting tube 56 (see FIGS. 2, 4 and 5). The connecting tube 56 is rotatably joined with the air passage of the suction nozzle assembly 30 through a connecting part 35, so that when the supporting unit 50 is hinged on the suction nozzle assembly 30, the connecting tube is communicated with the air passage of the suction nozzle assembly 30.

Accordingly, when the vacuum cleaner 1 is used in the upright form, the user can freely rotate the cleaner body 10 from a vertical position (see FIG. 1) to a horizontal position (not shown) through the supporting unit 50.

Referring to FIGS. 2 through 7, the locking unit 70, which detachably locks the lower part 11 of the cleaner body 10 on the supporting member 51 of the supporting unit 50, is made up of first and second locking parts 71 and 75.

The first locking part 71 is provided with at least one, for example, first, second and third projections 71*a*, 71*b*, and 71*c* (see FIGS. 5 through 7), formed on the lower surface of the cleaner body 10, and at least one, for example, first, second and third recess 72*a*, 72*b*, and 72*c*, formed on the supporting member 51 of the supporting unit 50 to face the first, the second and the third projections 71*a*, 71*b*, and 71*c*.

As illustrated in FIGS. 2 and 5, the first and the second projections 71*a* and 71*b* are formed on bottom surfaces of first and second supporting mounts 11*a* and 11*b*, which are formed in a spaced-apart relation to each other in front of the lower surface of the cleaner body 10, and the third projection 71*c* is formed of a rectangular protrusion formed in the middle of the lower surface of the cleaner body 10. The first and the second recesses 72*a* and 72*b* are formed on the supporting member 51 to face the first and the second projections 71*a* and 71*b*, and the third recess 72*c* is formed on the supporting member 51 to face the third projection 71*c*.

Accordingly, when the cleaner body 10 is mounted on the supporting unit 50, the first, the second and the third recesses 72*a*, 72*b*, and 72*c* accommodate the first, the second and the third projections 71*a*, 71*b* and 71*c*, so that they unmovably support the lower part of the cleaner body 10 to the supporting member 51.

The second locking part 75 detachably fixes the lower part 11 of the cleaner body 10 to the supporting member 51. For this, the second locking part 75 is provided with at least one, for example, first and second locking grooves 76*a* (only the first locking groove illustrated in FIGS. 5 through 7), a locking member 77, and an elastic member 79.

The first and the second locking grooves 76*a* are formed in a spaced-apart relation to each other on a lower part of the rear surface of the cleaner body 10.

Figure 8:
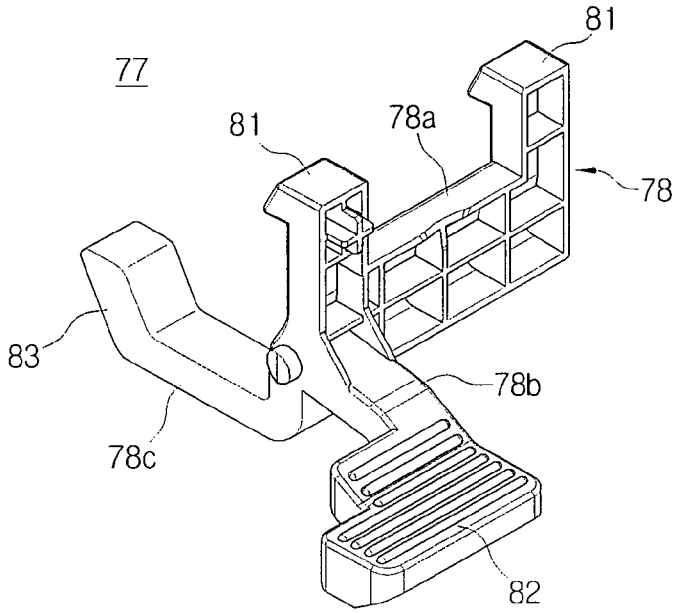
FIG. 8 is a perspective view exemplifying a locking member of a second locking part of the locking unit illustrated in FIGS. 5 through 7.

The locking member 77 is made up of an Y-shaped lever 78, which is rotatably supported on a rotating axis 61 of the supporting unit 50. The Y-shaped lever 78 is provided with first, second and third ends 78*a*, 78*b* and 78*c*. As illustrated in FIG. 8, the first end 78*a* of the Y-shaped lever 78 has first and second hooks 81 projecting out of the supporting member 51 toward the first and the second locking grooves 76*a*, so that when the cleaner body 10 is mounted on the supporting member 51 of the supporting unit 50, first and second hooks 81 are locked in the first and the second locking grooves 76*a*. The second end 78*b* has a pedal 82 projecting out of the hinge member 55 of the supporting unit 50 to be exposed to the outside. The third end 78*c* has a contact part 83 constructed to come in contact with the lower surface of the cleaner body 10 in the supporting unit 50, so that the contact part 83 lifts up the cleaner body 10 when the pedal 82 is pushed down with user's foot.

The elastic member 79 elastically urges the first end 78*a* of the Y-shaped lever 78, so that the first and the second hooks 81 of the first end 78*a* of the Y-shaped lever 78 are locked in the first and the second locking grooves 76*a* when the cleaner body 10 is mounted on the supporting member 51 of the supporting unit 50. For this, the elastic member 79 is installed on a fixing mount 62 of the hinge member 55 between the hinge member 55 and the first end 78*a* of the Y-shaped lever 78.

As illustrated in FIGS. 2 and 5, the second locking part 75 further includes a positioning member 85 configured to ensure that the first and the second hooks 81 are locked in the first and the second locking grooves 76*a* when the cleaner body 10 is mounted on the supporting unit 50. The positioning member 85 is provided with a positioning groove 86 formed in the rear of the lower surface of the cleaner body 10 adjacent to the first and the second locking grooves 76*a*, and a positioning projection 87 projecting from the supporting member 51 to face the positioning groove 86 while spaced apart from the first and the second hooks 81.

Figure 6:
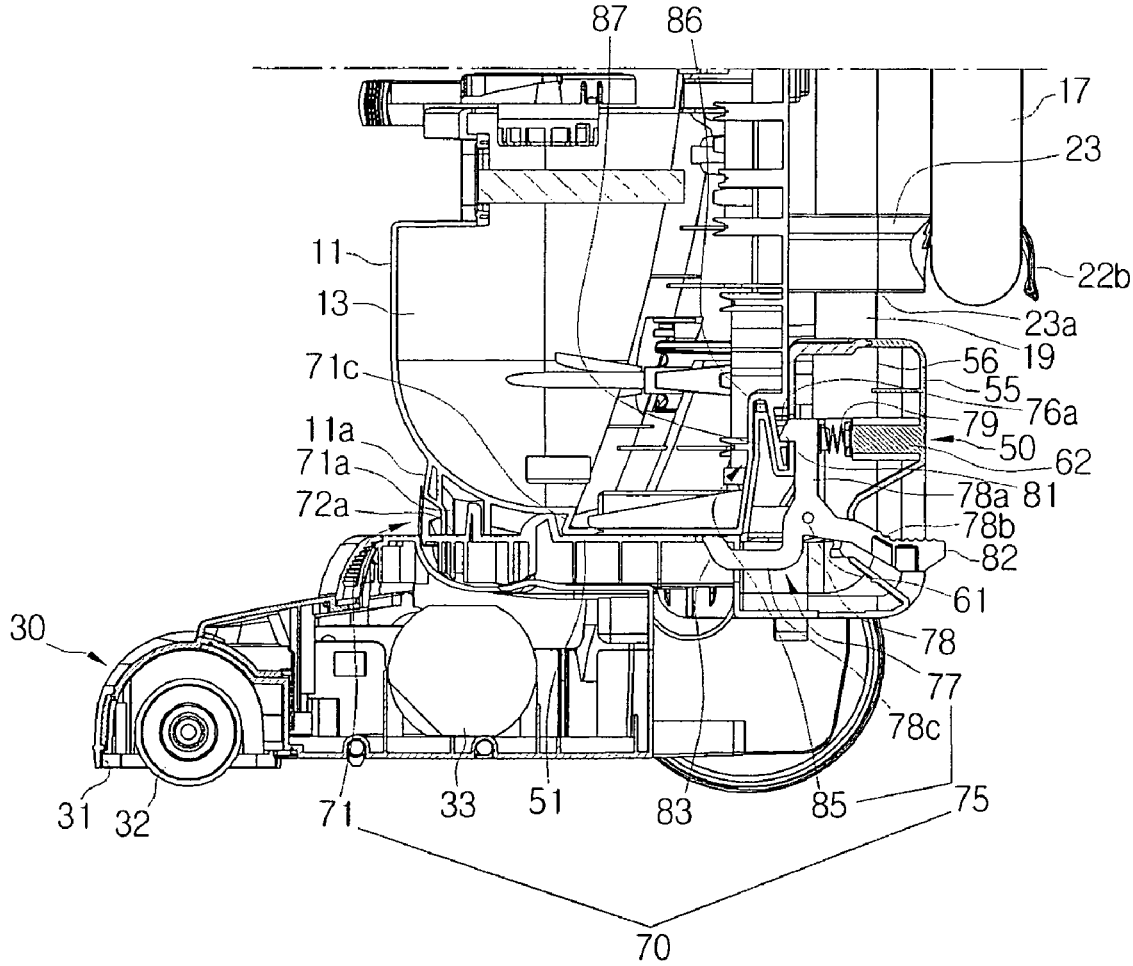

Accordingly, to mount the cleaner body 10 on the supporting member 51 of the supporting unit 50 and thus to join the cleaner body 10 with the suction nozzle assembly 30, when a rear portion of the lower surface of the cleaner body 10 is placed on the supporting member 51, as illustrated in FIG. 5, the positioning projection 87 is inserted into the positioning groove 86 to the position where the first and the second hooks 81 are locked in the first and the second locking grooves 76*a*. At this time, a lower part of the rear surface of the cleaner body 10 adjacent to the positioning groove 86 is inserted into a space between the positioning projection 87 and the supporting member 51 while pushing the first end 78*a* of the Y-shaped lever 78 against an elastic force of the elastic member 79. After that, as illustrated in FIG. 6, when the positioning projection 87 is completely inserted into the positioning groove 86, that is, when the lower part of the rear surface of the cleaner body 10 is completely inserted into the space between the positioning projection 87 and the supporting member 51, the first and the second hooks 81 of the first end 78*a* are inserted into and locked in the first and the second locking grooves 76*a* by the elastic force of the elastic member 79 and a force of the cleaner body 10 of pushing the contact part 83 of the third end 78*c*. As a result, the cleaner body 10 is unmovably fixed on the supporting member 51 of the supporting unit 50.

Figure 7:
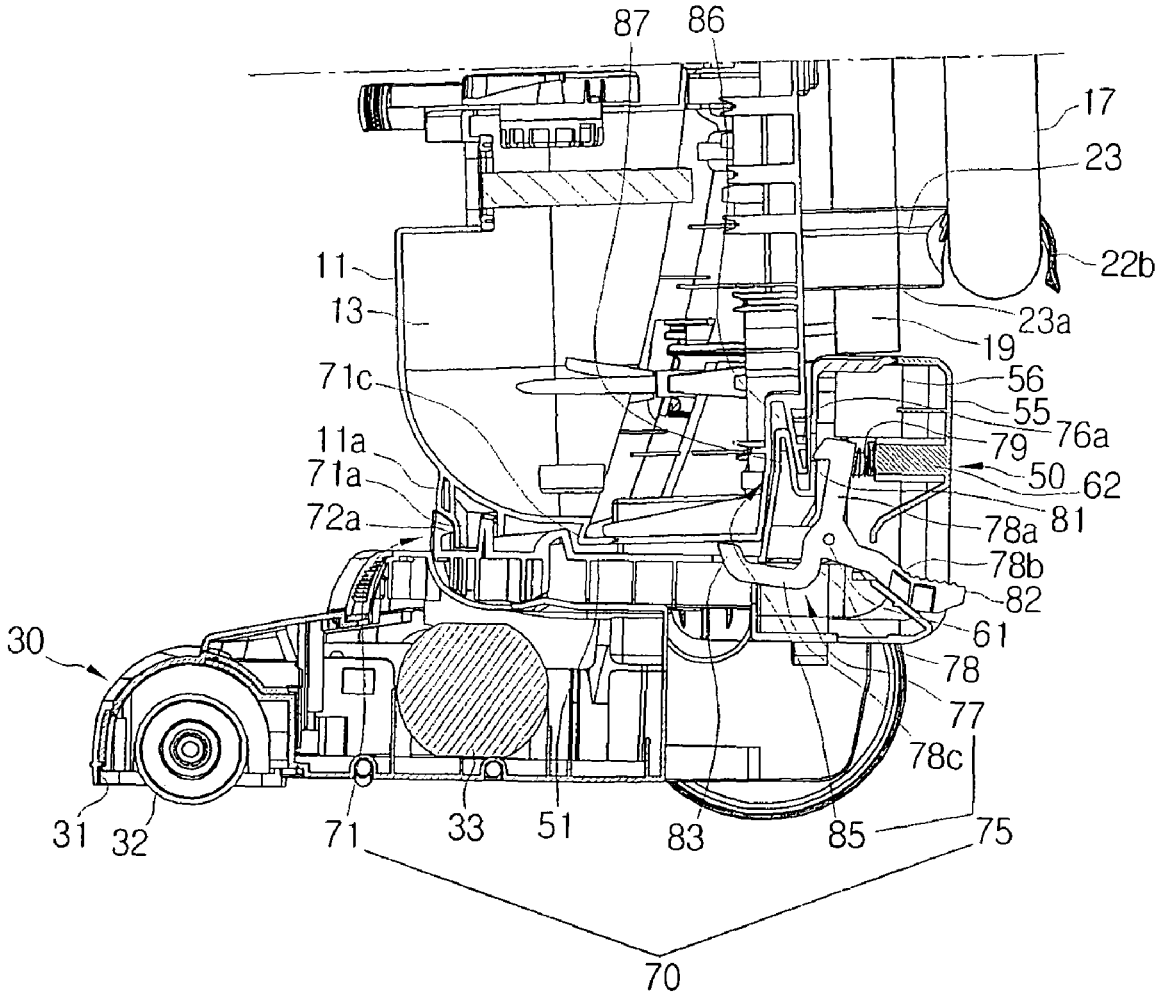

To the contrary, to dismount the cleaner body 10 from the supporting member 51 of the supporting unit 50 thus to separate the cleaner body 10 from the suction nozzle assembly 30, the pedal 82 of the second end 78*b* of the Y-shaped lever 78 is pushed with the user's foot, as illustrated in FIG. 7, so that the first and the second hooks 81 of the first end 78*a* are released from the first and second locking grooves 76*a* against the elastic force of the elastic member 79 and at the same time, the contact part 83 of the third end 78*c* pushes the lower surface of the cleaner body 10 to lift up the cleaner body 10. As a result, the lower part of the rear surface of the cleaner body 10 adjacent to the positioning groove 86 is lifted up as much as the cleaner body 10 is lifted up, so that the cleaner body 10 is positioned in a position of facing the first and the second hooks 81 of the first end 78*a* of the Y-shaped lever 78. Accordingly, the cleaner body 10 can be freely separated from the supporting member 51 of the supporting unit 50.

Figure 9:
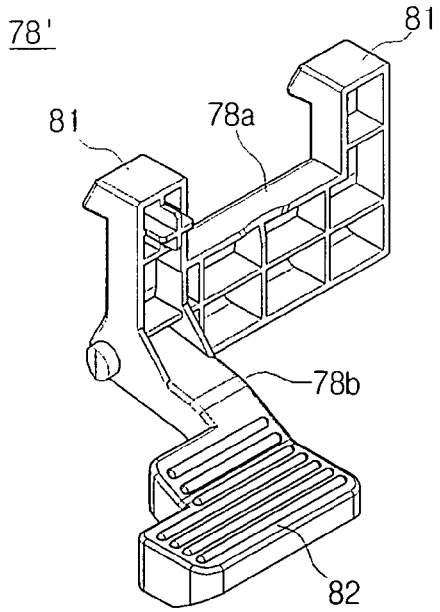
FIG. 9 is a perspective view exemplifying a modified example of the locking member of the second locking part of the locking unit illustrated in FIG. 8.

In the above description, although the vacuum cleaner 1 for use in both the upright form and the canister form according to the exemplary embodiment of the present disclosure has been explained and illustrated as having the locking member 77 of the second locking part 75 made up of the Y-shaped lever 78, the present disclosure is not limited to this. For instance, as illustrated in FIG. 9, the locking member 77 of the second locking part 75 can be formed of a L-shaped member 78' having a first end 78*a* with the first and the second hooks 81 and a second end 78*b* with the pedal 82. In this case, when the pedal 81 of the second end 78*b* of the L-shaped member 78' is pushed with the user's foot, the L-shaped member 78' does not push the lower surface of the cleaner body 10 to lift up the cleaner body 10 because it does not have the contact part 83 of the third end 78*c*. Accordingly, at this time, the user removes the cleaner body 10 from the supporting member 51 of the supporting unit 50 in a state where she or he pushes the pedal 82 of the second end 78*b* with her or his foot to release a locking connection between the first and the second hooks 81 and the first and the second locking grooves 76*a*.

Hereinafter, an operation of using the vacuum cleaner 1 according to the exemplary embodiment of the present disclosure constructed as described above in the upright form and the canister form will be described with reference to FIGS. 1 through 7.

First, an operation of changing the vacuum cleaner 1 in the upright form as illustrated in FIG. 1 from a state where it is used in the canister form as illustrated in FIG. 2 is explained below.

To mount the cleaner body 10 on the supporting unit 50 thus to join the cleaner body 10 with the suction nozzle assembly 30, the user grasps the body handle 20, and then places the first and the second supporting mounts 11*a* and 11*b* located in front of the lower surface of the cleaner body 10 on the first and the second recesses 72*a* and 72*b* with the cleaner body 10 diagonally inclined forward. At this time, the first and the second recesses 72*a* and 72*b* of the supporting member 51 accommodate the first and the second projections 71*a* and 71*b* of the first and the second supporting mounts 11*a* and 11*b*, and the third recess 72*c* partially accommodates the third projection 71*c*.

Subsequently, the user pulls the cleaner body 10 rearward to insert the positioning projection 87 into the positioning groove 86 and thus to position a mounting position of the cleaner body 10 where the first and the second hooks 81 can be locked in the first and the second locking grooves 76*a*. At this time, as explained above with reference to FIGS. 5 and 6, the lower part of the rear surface of the cleaner body 10 adjacent to the positioning groove 86 is inserted into the space between the positioning projection 87 and the supporting member 51 while pushing the first end 78*a* of the Y-shaped lever 78 against the elastic force of the elastic member 79, and the first and the second hooks 81 of the first end 78*a* are inserted into and locked in the first and the second locking grooves 76*a* by the elastic force of the elastic member 79. Also, a lower end of the extended tube 19 is inserted into and joined to the connecting tube 56 of the hinge member 55. As a result, the cleaner body 10 is unmovably fixed on the supporting unit 50.

Under this state, the user freely rotates the cleaner body 10 from a vertical position (see FIG. 1) to a horizontal position (not shown) through the supporting unit 50 by using the body handle 20, and at the same time, moves the suction nozzle assembly 30 along a surface to be cleaned to carry out a cleaning operation.

Next, an operation of changing the vacuum cleaner 1 to the canister form as illustrated in FIG. 2 from a state where it is used in the upright form as illustrated in FIG. 1 is explained below.

To dismount the cleaner body 10 from the supporting unit 50 thus to separate the cleaner body 10 from the suction nozzle assembly 30, the user pushes down the pedal 82 of the second end 78*b* of the Y-shaped lever 78 with his or her foot.

Then, the first and the second hooks 81 of the first end 78*a* are released from the first and second locking grooves 76*a* against the elastic force of the elastic member 79, as explained above with reference to FIG. 7, and at the same time, the contact part 83 of the third end 78*c* pushes the lower surface of the cleaner body 10 to lift up the cleaner body 10. Under this state, the user grasps the body handle 20 to separate and remove the cleaner body 10 from the supporting member 51, as illustrated in FIG. 2.

After that, the user grasps the operating handle 18 of the extended tube assembly 16 and pulls out the extended tube 19 from an opening groove 20*a* and the supporting hole 23*a* of the extended tube fixing part 23 and at the same time, pulls out the extended hose 17 from the upper and the lower hangers 22*a* and 22*b*. And then, the user connects the lower end of the extended tube 19 is to a suction brush or other accessories, which can clean a narrow area or a portion having a protrusion on a floor.

Subsequently, the user lays down the cleaner body, so that the first and the second small wheels 21*a* and the lower part 11 thereof touches the surface to be cleaned, that is, a floor. The user grasps the operating handle 18 of the extended tube assembly 16 and moves the suction brush or the other accessories connected to the lower end of the extended tube 19 along the surface to be cleaned to carry out the cleaning operation.

As apparent from the foregoing description, according to the exemplary embodiment of the present disclosure, the vacuum cleaner for use in both the upright form and the canister form is configured, so that the supporting unit detachably support the lower part of the cleaner body. Accordingly, the vacuum cleaner according to the exemplary embodiment of the present disclosure does not need to form the supporting unit in an arch shape larger than the outer circumference of the cleaner body as in the conventional vacuum cleaner. Thus the vacuum cleaner is not only slimmed in size, but also can freely attach various accessories, such as the extended tube assembly or the like, to the cleaner body.

Also, the vacuum cleaner according to the exemplary embodiment of the present disclosure is configured, so that the locking unit includes the first locking part to unmovably support the supporting member and the lower surface of the cleaner body to each other, and the second locking part 75 to detachably lock the supporting member and the lower part of the rear surface of the cleaner body to each other. Accordingly, when the vacuum cleaner is used in the upright form, which joins the cleaner body to the suction nozzle assembly, the user can easily mount the cleaner body to the supporting member by supporting the lower surface of the cleaner body on the supporting member through the first locking part and at the same time locking the lower part of the rear surface of the cleaner body in the supporting member through the second locking part while placing the cleaner body on the supporting member. To the contrary, when the vacuum cleaner is used in the canister form, which separates the cleaner body from the suction nozzle assembly, the user can easily dismount the cleaner body from the supporting member by releasing the locking connection between the supporting member and the lower part of the rear surface of the cleaner body through the second locking part and then removing the cleaner body from the supporting member.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner, comprising:

a suction nozzle assembly to draw in dust or dirt along with air while moving along a surface to be cleaned;

a cleaner body having a dust separating unit to separate and collect the dust or dirt from the air drawn in from the surface to be cleaned;

a supporting unit hingedly joined to the suction nozzle assembly to support a lower part of the cleaner body to communicate with the suction nozzle assembly; and a locking unit to detachably lock the lower part of the cleaner body to the supporting unit, wherein the locking unit comprises:

a first locking part to support a lower surface of the cleaner body and the supporting unit so as not to move with respect to each other, and a second locking part to detachably fix one side surface of the lower part of the cleaner body and the supporting unit to each other, wherein the second locking part comprises:

at least one locking groove formed on the one side surface of the lower part of the cleaner body;

a locking member rotatably supported on the supporting unit, and having at least one hook locked in the at least one locking groove when the cleaner body is mounted on the supporting unit; and an elastic member to elastically urge the locking member to allow the at least one hook to be locked in the at least one locking groove when the cleaner body is mounted on the supporting unit, and wherein the locking member comprises an Y-shaped lever, a first end of which has at least one hook projecting out of the supporting unit toward the at least one locking groove, a second end of which has a pedal projecting out of the supporting unit to allow a user to push, and a third end of which has a contact part disposed in the supporting unit to come in contact with the lower surface of the cleaner body and thus to lift up the cleaner body when the pedal is pushed.

2. The vacuum cleaner as claimed in claim 1, wherein the cleaner body further comprises an extended tube assembly detachably disposed in a longitudinal direction on one side of the cleaner body to communicate with the cleaner body.

3. The vacuum cleaner as claimed in claim 2, wherein the extended tube assembly comprises:

a suction hose connected to the cleaner body to communicate with the cleaner body;

an operating handle connected to the suction hose; and an extended tube having one end to connected to the operating handle.

4. The vacuum cleaner as claimed in claim 3, wherein the extended tube has another end that is connected to the suction nozzle assembly to act as an air flowing passage when the vacuum cleaner is used in a upright form, and is separated from the suction nozzle assembly and joined with a suction brush or different accessory for cleaning a narrow region or a portion having a protrusion on a floor when the vacuum cleaner is used in a canister form.

5. The vacuum cleaner as claimed in claim 1, wherein the first locking part comprises:

at least one projection formed on the lower surface of the cleaner body; and at least one recess formed opposite to the at least one projection on the supporting unit.

6. The vacuum cleaner as claimed in claim 5, wherein the at least one projection comprises first and second projections formed on bottom surfaces of supporting mounts formed in a spaced-apart relation to one another in front of the lower surface of the cleaner body, and a third projection formed in a middle of the lower surface of the cleaner body, and wherein the at least one recess comprises first and second recesses formed opposite to the first and the second projections on the supporting unit, and a third recess formed opposite to the third projection on the supporting unit.

7. The vacuum cleaner as claimed in claim 1, wherein the second locking part further comprises a positioning member to position the at least one hook to a position where the at least one hook is locked in the at least one locking groove when the cleaner body is mounted on the supporting unit.

8. The vacuum cleaner as claimed in claim 7, wherein the positioning member comprises:

a positioning groove formed in a rear of the lower surface of the cleaner body adjacent to the at least one locking groove; and a positioning projection projecting from the supporting unit to face the positioning groove while being spaced-apart from the at least one hook.

* * * * *